US005543594A

United States Patent [19]

Romero-Herrera

[11] Patent Number: 5,543,594

[45] Date of Patent: Aug. 6, 1996

[54] ELECTRICAL PUSH BUTTON SWITCH WITH BUILT-IN LAMP

[76] Inventor: Ricardo Romero-Herrera, Pasaje Garbí 16, 08840 Viladecans (Barcelona), Spain

[21] Appl. No.: 369,139

[22] Filed: Jan. 5, 1995

[30] Foreign Application Priority Data

Jan. 5, 1994 [ES] Spain ..... 9400015

[51] Int. Cl.[6] ..... H01H 9/18

[52] U.S. Cl. ..... 200/314

[58] Field of Search ..... 200/314

[56] References Cited

U.S. PATENT DOCUMENTS

| | | | |
|---|---|---|---|
| 3,740,501 | 6/1973 | Kiessling et al. | 200/314 X |
| 3,983,348 | 9/1976 | Kellogg | 200/314 |
| 4,871,890 | 10/1989 | Herrera | 200/314 |

FOREIGN PATENT DOCUMENTS

| | | | |
|---|---|---|---|
| 2917367 | 10/1980 | Germany | 200/314 |

*Primary Examiner*—Renee S. Luebke
*Attorney, Agent, or Firm*—Graybeal Jackson Haley & Johnson

[57] ABSTRACT

A miniature electrical push-button switch with built-in lamp comprises a push-button (13) having a translucent cover and a housing (10) in which the push-button (13) is seated. A tubular part (10*a*) of housing (10) is externally threaded for fastening nut (11) to the switch. A pushing member (13*a*) is attached to push-button (13) for actuation of microswitch (15). A socket comprises a disc-shaped base (18) removably linked to an end of tubular part (10*a*) that supports microswitch (15) and spring (40) for biasing pushing member (13*a*) away from microswitch (15). A portion of the socket is a lamp holder that extends outwardly from the tubular part (10*a*) forming a nucleus (17) and two flaps (19*a*, 19*b*) having stubs (20) at their ends for the attachment of microswitch (15). Microswitch (15) is also held by external surface (17*a*) of nucleus (17) and retained by resilient leg (21).

11 Claims, 1 Drawing Sheet

ELECTRICAL PUSH BUTTON SWITCH WITH BUILT-IN LAMP

BACKGROUND OF THE INVENTION

The present invention relates to an electrical push-button switch, with built-in lamp, which allows one to clearly see the push-button.

More specifically, the invention refers to a switch of small dimensions of the type which comprises a tubular housing of dielectric material with an external threaded portion for fastening a nut onto a control panel of the apparatus in which the switch is to be incorporated. The tubular housing has, at one of its ends, a box or casing holding a button with a translucent cover. The button includes a pushing member in said tubular housing that acts on a microswitch, which, in turn, is mounted on a socket removably linked to the housing. The socket and a lamp remain held within the housing and the pushing member is biased by a spring toward a disconnecting position. In particular, the socket is for coupling small bulbs having no lampholder and having a tail on one end of a glass blister. Threads acting as terminals connect to the internal filament, these terminals are held by clamp-shaped connecting pins arranged in the interior of the socket of the switch, which grips the bulb tail.

Known embodiments of this kind of switch, such as the ones referred to in ES-A-U8600488 and in U.S. Pat. No. 4,871,890, are not appropriate for the construction of a miniaturized push-button switch, which is the object of this invention. In particular, they have a first drawback referring to locking on the control panel. Insertion of the switch through holes require the dismounting of at least the microswitch due to its large size. Also, replacment of the lamp bulb is a difficult operation.

A second drawback is the difficulty of holding inside a push-button of small size, and, in particular, of short length, a lampholder, the corresponding lamp, and microswitch.

A third drawback is the difficulty of handling the socket body to which the switch is attached, which demands one seize and handle the socket body by some pins designed to lock the microswitch, with risk of these pins being broken.

SUMMARY OF THE INVENTION

Therefore, an object of this invention is to eliminate the present drawbacks in the push-button switches of the state of the art, while enhancing, in particular, the possibilities of miniaturization of the assembly while keeping effective lighting of the push-button.

It is also an object of this invention to provide an assembly of reduced dimensions which can be installed at a service point, complete, without dismounting any of its components, by means of a particular arrangement of the means locking the microswitch to the socket body.

The push-button switch proposed likewise constitutes an assembly in which the mounting and dismounting and the disassembly of the socket body of the tubular housing which lodges the push-button are conveniently facilitated.

Essentially, the push-button electric switch is characterized in that it includes a socket body for holding a lamp in which its lampholder (or part forming a lodging recess for the lamp's tail) extends outwardly from a tubular portion of the housing, forming an easy to grip nucleus which facilitates the mounting of the socket-body. In addition, only one part of the lamp protrudes inwardly into the housing. The nucleus emanates from a disc-shaped base, with respect to which it is slightly offset. Two flaps with stubs at their ends emerge from the nucleus to secure the microswitch (the flaps likewise effectively secure the body). The microswitch also is held by one wall of the nucleus and by a resilient leg directly opposite the wall and which emerges from the edge of the disc-shaped base. The disc-shaped base has a peripheral rib for attachment with an annular groove of the internal wall of the tubular portion of the housing. The width of the flaps and the span of the microswitch are such they do not protrude from the disc-shaped base's periphery, such that the entire switch can pass through insertion holes of the panel, once the nut is removed, to be re-attached after the insertion (without the need for dismantling any of the other components).

In a preferred embodiment of the socket-body, the two flaps which protrude from the nucleus to hold the microswitch are coplanar to the wall against which the microswitch is held.

The disc-shaped base has close to its edge a protuberance or thickened portion which includes a hole through which passes a prong comprised of electrical conducting material, which may constitute a ground connection for the switch.

The disc-shaped base has at its opposite edges notches for passing therethrough two elbowed ends of flexible legs which extend from the push-button member. These notches guide and retain the push-button in the housing. A third larger notch, located at the quadrant opposite to the above-mentioned thickened portion, is for the passage therethrough of a third leg on the push-button having a bent driver tab on its end to drive the microswitch.

BRIEF DESCRIPTION OF THE DRAWINGS

For a better understanding, the present invention will be further described in greater detail with reference to the accompanying drawings which are presented for exemplary purposes only, and to illustrate one practical embodiment of the push-button switch herein. In the drawings.

DESCRIPTION OF THE PREFERRED EMBODIMENTS

Figure 1:
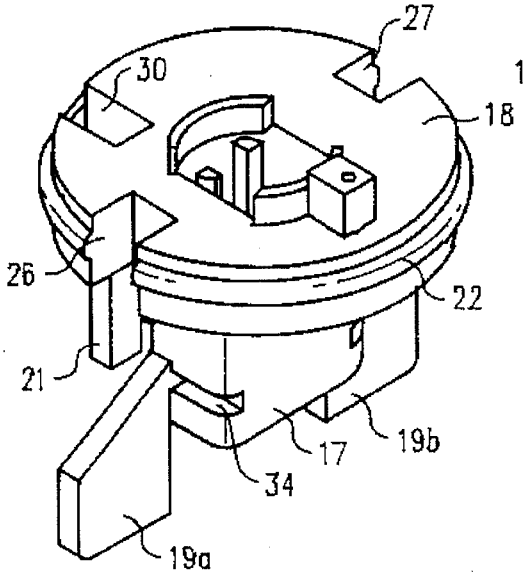
FIG. 1 is a perspective view of a socket body comprising a lampholder which includes means to fasten a microswitch.
Figure 2:
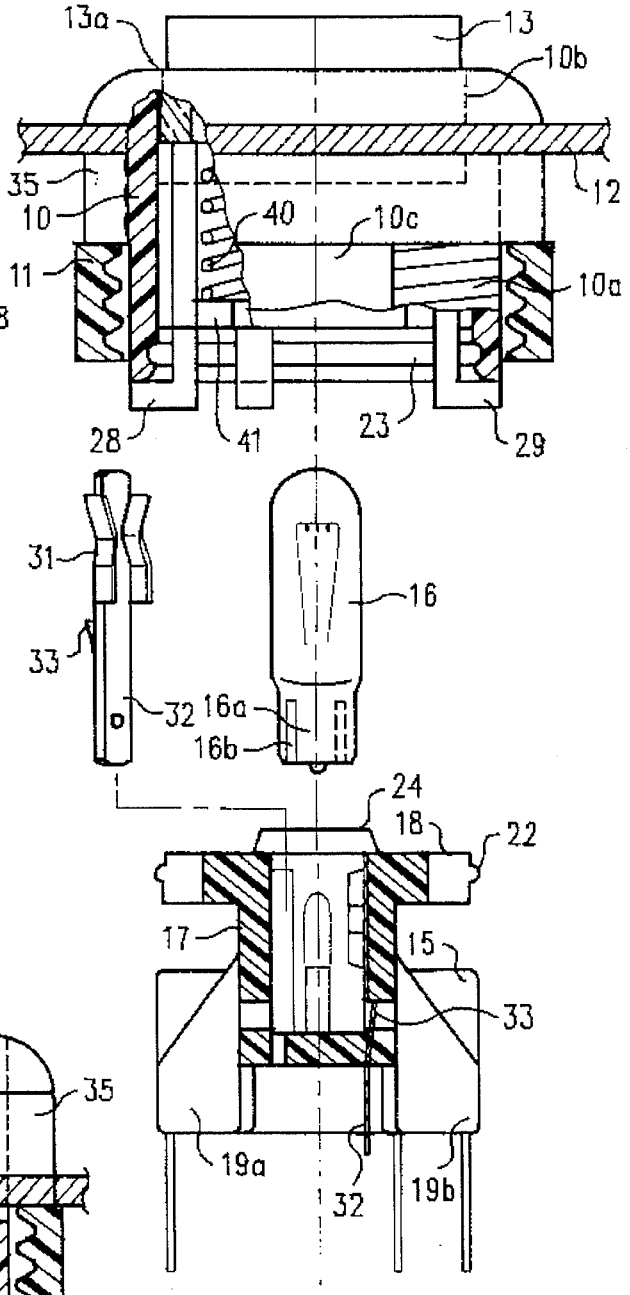
FIG. 2 is a side elevational exploded view, partly in section, of the push-button switch disassembled.
Figure 3:
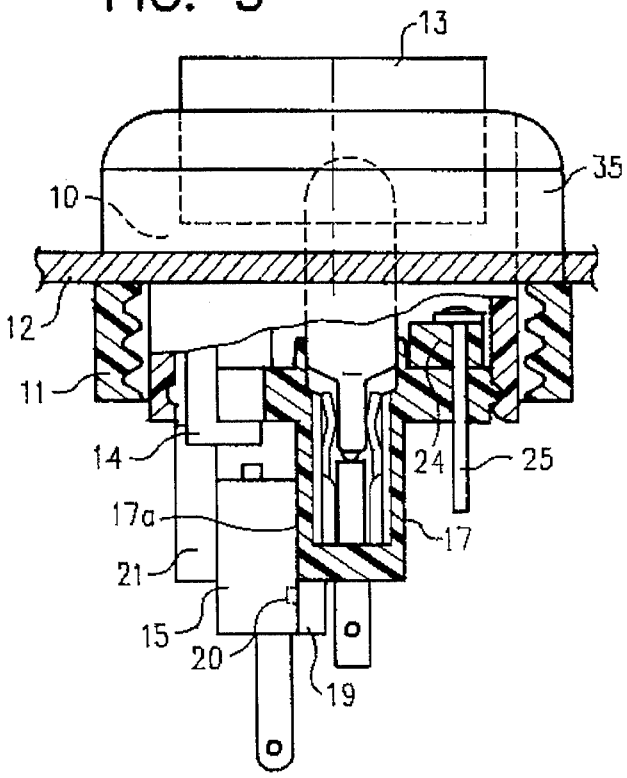
FIG. 3 is a side elevational view, likewise partly in section, of the push-button switch, mounted to show how only the bulb of the lamp is inside the housing and remains close to the push-button to facilitate miniaturization of the switch.

Referring to FIGS. 1–3, the push-button electric switch with built-in lamp of the present invention includes a housing 10 with a tubular portion 10*a* externally threaded (and flat intermediate portions 10*c* for locking the push-button electric switch by means of a nut 11 to a control panel or board 12 provided with holes for inserting therethrough with a minimum clearance the tubular part 10*a* of the housing 10). In addition, the housing 10 is provided at one of its ends with a casing 10*b* which holds a push-button 13 having a translucent cover, push-button 13 including a pushing member 13*a* held in the tubular part 10*a* of housing 10 and biased by a spring 40 seated on a tab 41 toward a disconnecting position. Pushing member 13*a* is designed to act on a microswitch 15, which, in turn, is attached to a socket body holding a lamp 16 removably linked to the end of the housing 10 remote from the push-button 13. The casing 10*b* is surrounded by a frame 35 which can be located under the panel or board 12 (FIG. 2) or above thereof (FIG. 3).

This push-button electric switch, which has been designed to be of miniature size, is characterized in that the lampholder portion of the socket body, which supports the microswitch 15, extends outward from the tubular portion 10*a*, forming a nucleus 17 such that only a part of the bulb of lamp 16 protrudes into housing 10. Thus housing 10 can be of very short length. As can be seen in FIG. 1, the nucleus 17 protrudes from a disc-shaped base 18, with respect to which nucleus 17 is slightly offset. Flaps 19*a* and 19*b* with stubs 20 at their ends also protrude from disc-shaped base 18 and lock the microswitch 15 therebetween by insertion of stubs 20 in holes in the body of microswitch 15. The microswitch 15 is held against a wall 17*a* of nucleus 17 and retained by resilient leg 21 directly opposite wall 17*a* and which protrudes from the edge of disc-shaped base 18. Disc-shaped base 18 has a peripheral rib 22 for the attachment of the socket body to the housing 10, by coupling within an annular groove 23 on the internal wall of the tubular portion 10*a* of the housing 10.

The two flaps 19*a* and 19*b* which protrude from the nucleus 17 (or lampholder) of the socket body, as can be seen in FIGS. 1 and 3, are coplanar with wall 17*a*. Microswitch 15 thus is braced by wall 17*a* and flaps 19*a* and 19*b* on one side and resilient leg 21 on the other.

As can be seen in FIG. 2, the width of flaps 19*a* and 19*b* and of microswitch 15 are such that they do not protrude from the periphery of disc-shaped base 18 or housing 10. Thus, the push-button electric switch, in its entirety with the exception of the nut 11, can pass through a hole in panel 12, with nut 11 later being attached to the push-button electric switch without dismounting any of its components.

As illustrated in FIGS. 1 and 3, close to the outer periphery of disc-shaped base 18, there is a thickened portion 24 which includes a hole through which passes a prong 25 comprised of electrical conductive material, which may constitute a ground connection for the push-button electric switch.

The disc-shaped base 18 has, as can be seen in FIG. 1, at its peripheral edge two rectangular notches 26 and 27 that are located at diametrically opposite positions. Elbowed ends of flexible legs 28 and 29, located on the end of pushing member 13*c* of push-button 13, pass through notches 26 and 27 for retaining push-button 13 in housing 10. A third notch 30, of larger diameter and located in the opposite quadrant of disc-shaped base 18 to the quadrant thickened portion 24 occupies, is for the passage therethrough of a third leg 14 which activates microswitch 15.

In FIG. 2, the lamp 16 used as a lighting element for translucent push-button 13 is shown in detail. Lamp 16 includes a small bulb provided with a tail 16*a* on which are backed conducting threads 16*b* that act as terminals from the internal filament. Tail 16*a* is held by resilient pins 31, which form retaining clamps and which extend into electricity conducting flat appendages 32 which constitute the terminals for current collection and which are inserted in nucleus 17 of the lampholder. Flat appendages 32 are anchored in channels in nucleus 17 by a rim 33, which protrudes through openings on the sides of nucleus 17.

While particular embodiments of the present invention have been described in some detail herein above, changes and modifications may be made in the illustrated embodiments without departing from the spirit of the invention.

What is claimed is:

1. An electrical push-button switch with a built-in lamp comprising:

a push-button having a translucent cover;

a housing in which said push-button is seated, at least part of said housing being a substantially tubular body with an externally threaded portion for removably attaching said switch to a control panel with a threaded fastening means;

a pushing member which extends from said push-button and is at least partially mounted in said tubular body for axial displacement therein;

a socket body comprising a disc-shaped base removably linked to an end of said tubular body wherein said socket body includes a lamp holder extending outwardly from said tubular body of said housing and terminating in a grippable nucleus, said nucleus having at least two flaps, each having an end with a stub thereon;

a microswitch attached to said socket body;

means for biasing said pushing member away from said microswitch; and a leg on a peripheral region of said disc-shaped base of said socket body and spaced from said nucleus wherein said microswitch is braced between an external surface of said nucleus and said leg.

2. An electrical push-button switch as claimed in claim 1, wherein said disc-shaped base of said socket body has a peripheral rib for coupling with an annular groove on an internal part of said tubular body near an open end thereof.

3. An electrical push-button switch as claimed in claim 1 wherein said two flaps protruding from said nucleus are coplanar of said external surface of said nucleus against which said microswitch is backed and do not extend past the periphery of said disc-shaped base.

4. An electrical push-button switch as claimed in claim 1, wherein said disc-shaped base further includes a thickened portion with a hole through which passes a prong of an electrical conductive material.

5. An electrical push-button switch as claimed in claim 1, wherein said disc-shaped base further includes at its peripheral edge two diametrically opposite notches through which pass two legs of said pushing member to guide and retain said push-button in said housing, said disc-shaped base also including a third notch through which passes a third leg from said pushing member to selectively actuate said microswitch.

6. An electrical push-button switch with a built-in lamp comprising:

a push-button having a translucent cover;

a housing in which said push-button is seated, at least part of said housing being a substantially tubular body with an externally threaded portion for removably attaching said switch to a control panel with a threaded fastening means;

a pushing member which extends from said push-button and is at least partially mounted in said tubular body for axial displacement therein;

a socket body comprising a disc-shaped base removably linked to an end of said tubular body wherein said socket body includes a lamp holder extending outwardly from said tubular body of said housing and terminating in a grippable nucleus;

a microswitch attached to said socket body;

means for biasing said pushing member away from said microswitch; and a leg on a peripheral region of said disc-shaped base of said socket body and spaced from said nucleus wherein said microswitch is braced between an external surface of said nucleus and said leg.

7. An electrical push-button switch as claimed in claim 6, wherein said disc-shaped base of said socket body has a peripheral rib for coupling with an annular groove on an internal part of said tubular body near an open end thereof.

8. An electrical push-button switch as claimed in claim 6 wherein two flaps protrude from said nucleus and are coplanar of said external surface of said nucleus against which said microswitch is backed and do not extend past the periphery of said disc-shaped base.

9. An electrical push-button switch as claimed in claim 8 wherein said flaps each further comprise an end with a stub thereon, said stub matable in an opening in said microswitch.

10. An electrical push-button switch as claimed in claim 6, wherein said disc-shaped base further includes a thickened portion with a hole through which passes a prong of an electrical conductive material.

11. An electrical push-button switch as claimed in claim 6, wherein said disc-shaped base further includes at its peripheral edge two diametrically opposite notches through which pass two legs of said pushing member to guide and retain said push-button in said housing, said disc-shaped base also including a third notch through which passes a third leg from said pushing member to selectively actuate said microswitch.

* * * * *